United States Patent [19]

Horkey

[11] 4,336,836

[45] Jun. 29, 1982

[54] HEAT RECLAIMER

[76] Inventor: Edward J. Horkey, 11208 S. Tomah St., Phoenix, Ariz. 85044

[21] Appl. No.: 112,804

[22] Filed: Jan. 16, 1980

[51] Int. Cl.[3] ..... F24H 3/00; F24C 1/00

[52] U.S. Cl. ..... 165/47; 165/102; 165/DIG. 2; 237/54; 126/248

[58] Field of Search ..... 165/47, 102, DIG. 2; 237/54, 55; 126/72, 102, 248

[56] References Cited

U.S. PATENT DOCUMENTS

| | | | |
|---|---|---|---|
| 43,992 | 8/1864 | Holmes | 165/DIG. 2 |
| 50,069 | 9/1865 | Goodrich | 165/102 |
| 53,789 | 4/1866 | Cook | 165/102 |
| 79,841 | 7/1868 | Lakin | 126/248 |
| 114,013 | 4/1871 | Jennings | 237/55 |
| 339,442 | 4/1886 | Marak | 165/102 |
| 349,534 | 9/1886 | Smith | 165/DIG. 2 |
| 374,436 | 12/1887 | Wakeman | 165/102 |
| 395,013 | 12/1888 | Tacey | 165/102 |
| 395,818 | 1/1889 | Edwards . | |
| 501,679 | 7/1893 | Dorr | 165/102 |
| 525,896 | 9/1894 | Grennell | 165/DIG. 2 |
| 525,990 | 9/1894 | Lyons | 165/102 |
| 653,676 | 7/1900 | Hilliker . | |
| 705,507 | 7/1902 | Williamson | 165/DIG. 2 |
| 756,970 | 4/1904 | Langell | 165/102 |
| 762,203 | 6/1904 | Segerstrom . | |
| 766,190 | 8/1904 | Loehr . | |
| 990,268 | 4/1911 | Hohmann | 126/248 |
| 1,280,235 | 10/1918 | Kermode | 126/77 |

*Primary Examiner*—Albert W. Davis
*Assistant Examiner*—Margaret A. Focarino
*Attorney, Agent, or Firm*—Donald P. Gabrielson

[57] ABSTRACT

An apparatus for reclaiming heat from the discharge gas from a combustion fuel heating unit, which has: inlet and outlet sections; an expansion section whose circumference gradually increases in the direction of flow, thereby providing an increased area for heat transfer; flow splitter plates which lie within and act in conjunction with the expansion section wall to form flow compartments, which flow splitter plates and expansion section wall have a slope, with respect to the centroidal axis of the flow compartment not exceeding 0.1228, which geometry prevents a separation of the flow from the enclosing walls, thereby increasing heat transfer and maintaining the drafting function; and a reduction section which converges the flow to the outlet section.

5 Claims, 4 Drawing Figures

HEAT RECLAIMER

BACKGROUND OF THE INVENTION

This invention is an article of manufacture, relating generally to heat transfer devices, and is concerned in particular with a heat reclaimer adapted for installation in the flue connecting a heater, such as for example a wood or coal fire home heating unit, to an exhaust pipe or chimney.

PRIOR ART

Various devices have been developed to reclaim heat from the exhaust pipe of a heater. While these devices do operate to reclaim additional heat, a common problem is encountered where the structure of the device upsets the draft required to maintain combustion. The result is that both back puffing of smoke and difficulty in developing a proper rate of combustion may ensure. Those devices which have addressed the problem of maintaining an adequate draft throughout the burning cycle have resulted in unduly complex mechanisms.

SUMMARY OF THE INVENTION

A general object of the invention is to provide a heat reclaimer which can recover, by exposing the flow to an increases surface area, a portion of the heat energy otherwise lost in the exhaust flow.

Another object of the invention is to provide a heat reclaimer whose structure functions to maintain the draft necessary to fire a conventional wood or coal heating unit.

DESCRIPTION OF THE DRAWINGS

These and other objects and advantages of the subject invention shall become more apparent as the description proceeds with the aid of the accompanying drawings wherein.

DESCRIPTION OF THE PREFERRED EMBODIMENT

Figure 1:
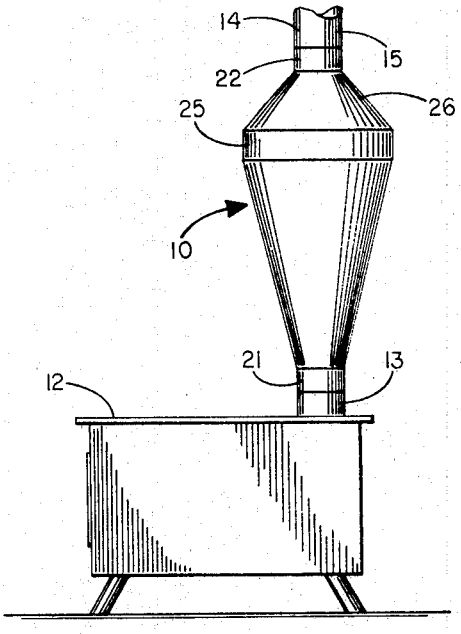
FIG. 1 is a schematic view of a heat reclaimer, embodying the concepts of the subject invention installed in a flue between a wood heater and an exhaust pipe.
Figure 2:
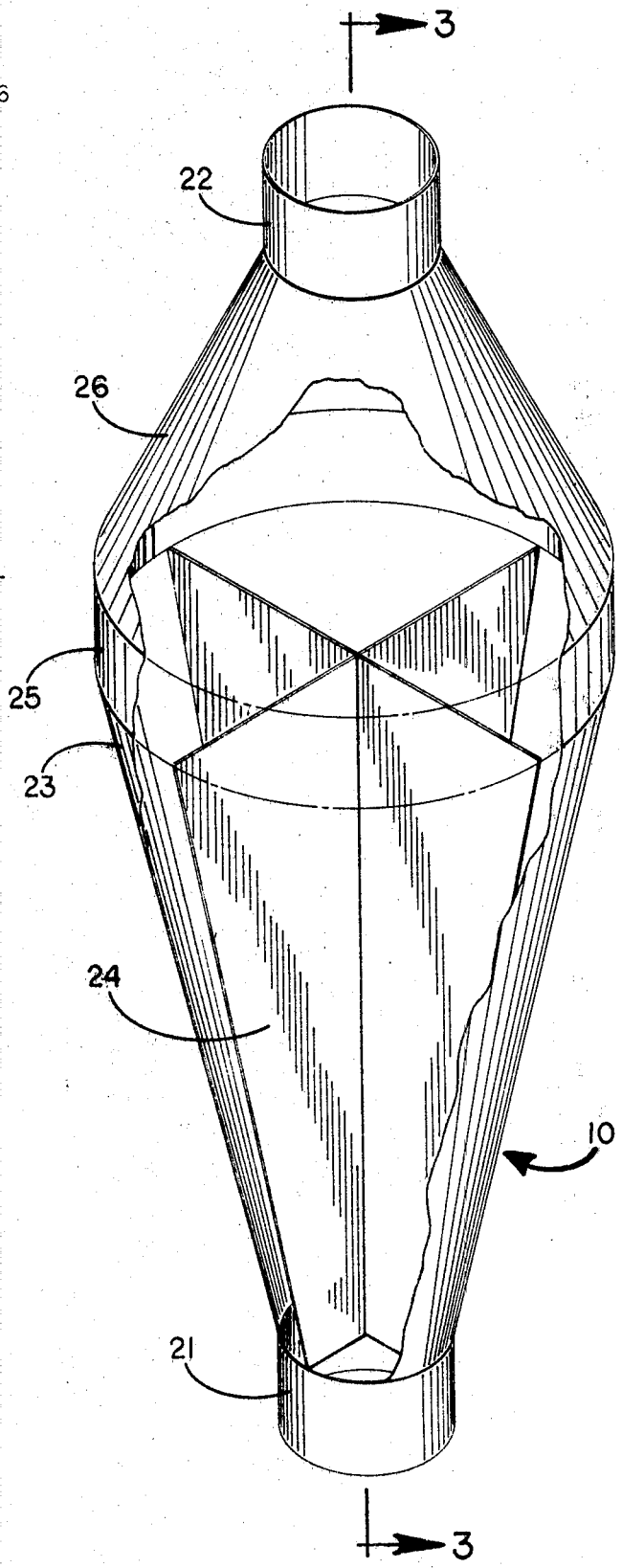
FIG. 2 is a perspective view with portions removed to disclose the internal structure.
Figure 4:
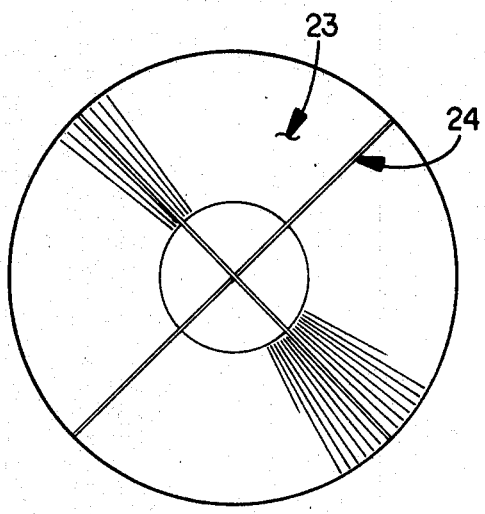
FIG. 4 is a section taken along lines 4—4 of FIG. 3.
Figure 3:
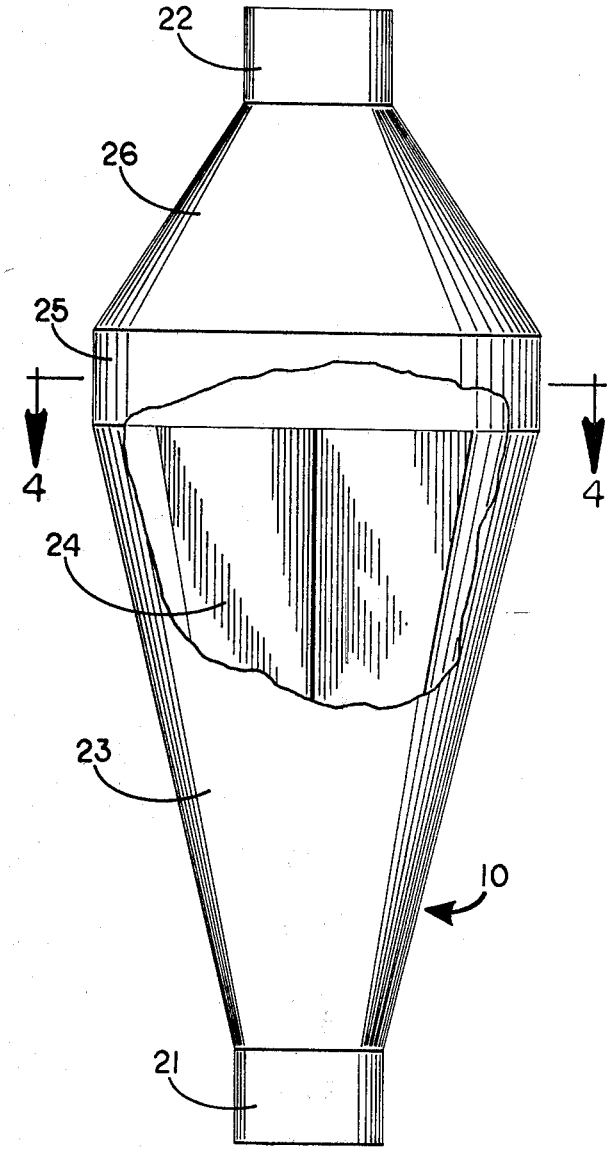
FIG. 3 is a view taken in the direction of lines 3—3 of FIG. 2.

Referring initially to FIG. 1, a heat reclaiming apparatus in accordance with the subject invention is shown generally at 10 installed between a heater 112 and an exhaust pipe of chimney 14.

The heater 12 is illustrated as comprising a wood fired unit as is commonly used as a heat source for occupied areas, which unit requires a natural convective draft.

Referring additionally to the other drawings, it will be seen that the apparatus 10 includes an inlet section 21 adapted for connection to one section 13 of a flue leading from the heater 12, and an outlet section 22 adapted for connection to one section 15 of the exhaust pipe or chimney 14. An expansion section 23, having a circumference which gradually increases in the direction of flow, is connected to the inlet section 21 and to an idler section 25. The expansion section 23 encloses flow splitter plates 23 which are radially arranged about the axis of the expansion section 23. A reduction section 26 is connected to the idler section 25 and to the outlet section 22, which is in turn connected to one section 15 of the exhaust pipe or chimney 14.

The operation of the subject invention may be described as follows. It will be seen that combustion occurring in heater 12 will produce a natural convective flow of heated gas and products of combustion through flue section 13 and toward the flue pipe or chimney 14. The heated gas passes from flue section 10 through inlet section 21 and into expansion section 23, wherein it is expanded by an increasing circumference thereby increasing the overall area for heat transfer and the quantity of heat transferred.

Means to prevent a separation of the flow from the wall of the expansion section is comprised of limiting the slope of the wall of the expansion section 23, with respect to the axis of the inlet section 21, to less than 0.1228. Utilization of a greater slope, or rate of change of the circumference, for the wall of the expansion section will produce a separation of the flow from the wall of the expansion section, with deleterious effects upon both the drafting function and the heat transfer rate.

Means to prevent a separation of the flow from the wall of the expansion section is further comprised of adding a plurality of flow splitter plates 24 to the interior of the expansion section 23. The connected flow splitter plates, which may be arranged radially about the axis of the expansion section, function with the wall of the expansion section to form separately diverging flow compartments. Each wall of each flow compartment may be arranged with a limiting slope of 0.1228 with respect to the centroidal axis of that flow compartment. For a frusto-conical shaped expansion section enclosing a single tier of radially arranged flow splitter plates, the slope of the wall of the expansion section, with respect to the axis of the inlet section 21, may be increased to a limiting value of 0.2493, thereby increasing further the overall area for heat transfer, while avoiding a disruption of the drafting function.

The idler section provides additional heat transfer area for the fully expanded flow. The reduction section 26, whose circumference gradually decreases in the direction of flow, converges the flow to enter the outlet section 22. The flow passes from the reduction section 22, through flue section 15 and into the exhaust pipe or chimney 14.

I claim:

1. A heat reclaimer apparatus having an inlet section and an outlet section, comprising in combination:

transfer means having walls for transferring heat from a flow of fluid;

expansion means provided with diverging flow compartments for controlling the expansion of said flow of fluid;

said expansion means including splitter means for forming in conjunction with said transfer means walls said plurality of diverging flow compartments;

said splitter means comprising a plurality of connected plates radially arranged about the inlet axis of said reclaimer; and said flow compartments each having at least one enclosing surface and a centroidal axis.

2. A heat reclaimer apparatus in accordance with claim 1, wherein said expansion means further comprising a geometric limitation upon said slope of said enclosing surface with respect to said centroidal axis and said slope does not exceed 0.1228.

3. A heat reclaimer apparatus in accordance with claim 2, wherein said expansion means further comprising a geometric limitation upon the slope of said flow compartment centroidal axis with respect to said inlet section axis and said slope does not exceed 0.1228.

4. A heat reclaimer apparatus in accordance with claim 3, wherein said transfer means further comprising an idler section having walls parallel to said inlet axis.

5. A heat reclaimer apparatus in accordance with claim 4, wherein said transfer means further comprising a reduction section having walls having a circumference which decreases in the direction of flow.

* * * * *